United States Patent [19]

Akagi et al.

[11] 4,407,244

[45] Oct. 4, 1983

[54] APPARATUS FOR CONTROLLING THE PROPORTION OF AIR AND FUEL IN THE AIR-FUEL MIXTURE OF THE INTERNAL COMBUSTION ENGINE

[75] Inventors: Motonobu Akagi, Kariya; Toshio Tanahashi; Kichiro Kato, both of Susono, all of Japan

[73] Assignees: Aisin Seiki Kabushiki Kaisha, Kariya; Toyota Jidosha Kabushiki Kaisha, Toyota, both of Japan

[21] Appl. No.: 390,890

[22] Filed: Jun. 22, 1982

[30] Foreign Application Priority Data

Jun. 27, 1981 [JP] Japan ..... 56-100110

[51] Int. Cl.[3] ..... F02M 7/24; F02M 23/04

[52] U.S. Cl. ..... 123/339; 123/589; 123/440

[58] Field of Search ..... 123/339, 440, 585–589

[56] References Cited

U.S. PATENT DOCUMENTS 4,132,199 1/1979 Kuroiwa et al. ..... 123/589
4,291,658 9/1981 Masaki et al. ..... 123/440
4,314,536 2/1982 Tipton ..... 123/440
4,356,797 11/1982 Matsui ..... 123/589
4,369,755 1/1983 Saito ..... 123/588

*Primary Examiner*—William A. Cuchlinski, Jr.
*Attorney, Agent, or Firm*—Oblon, Fisher, Spivak, McClelland & Maier

[57] ABSTRACT

An apparatus for controlling the proportion of air and fuel in the air-fuel mixture of the internal combustion engine includes a carburetor having a main system fuel tube, a main system air-bleeding passage, a slow system fuel tube and a slow system air-bleeding passage, and an electromagnetic control valve having an air-inlet port, a first outlet port communicating with the main system air-bleeding passage and a second outlet port communicating with the slow system air-bleeding passage, and internally provided with a moving-coil type linear motor. The electromagnetic control valve is adapted to cause the first outlet port to start to communicate with the air-inlet port a predetermined period of time after the second outlet port has started communicating with the air-inlet port, when an analog electric signal is applied to the linear motor.

4 Claims, 3 Drawing Figures

APPARATUS FOR CONTROLLING THE PROPORTION OF AIR AND FUEL IN THE AIR-FUEL MIXTURE OF THE INTERNAL COMBUSTION ENGINE

BACKGROUND OF THE INVENTION

1. Field of the Invention

The present invention relates to an apparatus to control the ratio of air to fuel of the air-fuel mixture which is applied to an internal combustion engine, and more particularly to an apparatus to control the ratio of air to fuel of air-fuel mixture through the control of the rate of air supplied to the main system fuel passage and the slow system fuel passage of a carburetor provided for supplying the air-fuel mixture to an internal combustion engine.

2. Description of the Prior Art

It is known to incorporate a catalytic converter having ternary catalytically active substances into the exhaust system of the internal combustion engine of an automobile in order to simultaneously reduce the components of exhaust gas which are injurious to health, such as hydrocarbons (HC), carbon monoxide (CO) and nitrogen oxides (NOx). It is required to supply an air-fuel mixture of an air-fuel ratio corresponding to the stoichiometric air-fuel ratio into the cylinders of an internal combustion engine, since the maximum cleaning efficiency of the ternary catalytically active substances is attained when the exhaust gas is produced by the combustion of an air-fuel mixture of the stoichiometric air-fuel ratio. An air-fuel ratio controller to meet such a requirement is known, which includes a main system air-bleeding passage connected to the main system fuel passage connecting to the main jet of a carburetor, a slow system air-bleeding passage connected to the slow system fuel passage connecting to the slow system fuel supply port of the carburetor, and a main system electromagnetic control valve for controlling the main system air bleeder and a slow system electromagnetic control valve for controlling the slow system air bleeder, which are disposed within the main system air-bleeding passage and the slow system air-bleeding passage, respectively, and are adapted to be controlled by a control signal provided by converting the output signal of an oxygen sensor disposed within the exhaust passage of the engine by means of an electronic control unit. It is proposed to control the quantity of air to be supplied to the main system fuel passage and to the slow system fuel passage through the main system air-bleeding passage and through the slow system air-bleeding passage, respectively, with an air-fuel ratio controller as described above, so that the air-fuel ratio of the air-fuel mixture which is supplied into the cylinders of an engine is controlled so as to be close to the stoichiometric air-fuel ratio. However, such proposal as described above has a disadvantage in controlling the air-fuel ratio. In a carburetor, fuel is supplied through the slow system fuel supply port while not being supplied through the main nozzle when the throttle opening is small, whereas the fuel is supplied through both the slow system fuel supply port and the main nozzle, mainly through the main nozzle, when the throttle opening is large. When the throttle opening is large, the required air-bleeding quantity in the main system is less as compared with the required air-bleeding quantity in the slow system when the throttle opening is small. Nevertheless, the air-fuel ratio controller is provided with a main system electromagnetic control valve and a slow system electromagnetic control valve of the same flow rate characteristic. Accordingly, an excessive quantity of air is supplied through the main system air-bleeding passage due to delayed response of the electromagnetic valve when the throttle valve is suddenly opened. Consequently, an excessively lean air-fuel mixture is supplied temporarily into the cylinders of the engine, thus resulting in irregular acceleration.

SUMMARY OF THE INVENTION

The primary object of the present invention is to provide, for an internal combustion engine, an apparatus capable of controlling the proportion of air and fuel of the air-fuel mixture appropriately corresponding to the operating state of the engine by supplying air to the main system air-bleeding passage of the carburetor of the internal combustion engine with a slight time-lag after air has been supplied into the slow system air-bleeding passage, in supplying air into the main system air-bleeding passage and the slow system air-bleeding passage of the carburetor.

According to the present invention, there is provided an apparatus for controlling the proportion of air and fuel in the air-fuel mixture of an internal combustion engine, comprising in combination: a carburetor, an electromagnetic control valve and a control means for controlling the valve. The carburetor includes an air horn tube having a venturi tube and a throttle valve connected to the intake manifold of an internal combustion engine, a main system fuel tube opening into a main nozzle formed in said venturi tube at one end thereof and communicating with a main system fuel passage through the other end thereof, a slow system fuel tube opening into a slow system fuel supply port formed near said throttle valve of the air horn tube at one end thereof and communicating with a slow system fuel passage through the other end thereof, a main system air-bleeding passage connected to said main system fuel tube for supplying air thereto, and a slow system air-bleeding passage connected to said slow system fuel tube for supplying air thereto. The electromagnetic control valve includes a box-shaped housing formed with a magnetic material and provided with an air-inlet port, a first outlet port connected to said main system air-bleeding passage and a second outlet port connected to said slow system air-bleeding passage, a tubular iron core supported on said housing at opposite ends thereof, having a first passage and a second passage communicating with said first outlet port and with said second outlet port, respectively, and being formed separately with each other and internally of the iron core, first valve openings formed in the part of the iron core provided with said first passage so as to allow the communication between said first outlet port and said air-inlet port, and second valve openings formed in the part of the iron core provided with said second passage so as to allow the communication between said second outlet port and said air-inlet port, a bobbin disposed so as to longitudinally slidably receive said iron core, provided with a solenoid which is wound partially along the longitudinal length thereof and having a first valve element and a second valve element which are formed so as to open and close the first valve openings and second valve openings, respectively, spring means urging said bobbin in a longitudinal direction of said iron core, and at least one pair of permanent magnets fixed to said housing at a position corresponding to said solenoid provided for said bobbin and so disposed that the direction of the magnetic flux is perpendicular to said solenoid. The control means is provided for supplying analog electric signals to said solenoid, whereby the bobbin is caused to slide on said iron core against the resilient force of said spring means due to application of said analog electric signals to said solenoid, and said first valve element starts opening said first valve openings a predetermined time after said second valve element has started opening said second valve openings.

BRIEF DESCRIPTION OF THE DRAWINGS

Various other objects, features and attendant advantages of the present invention will be more fully appreciated as the same becomes better understood from the following detailed description when considered in connection with the accompanying drawings wherein.

DETAILED DESCRIPTION OF THE PREFERRED EMBODIMENT

Figure 1:
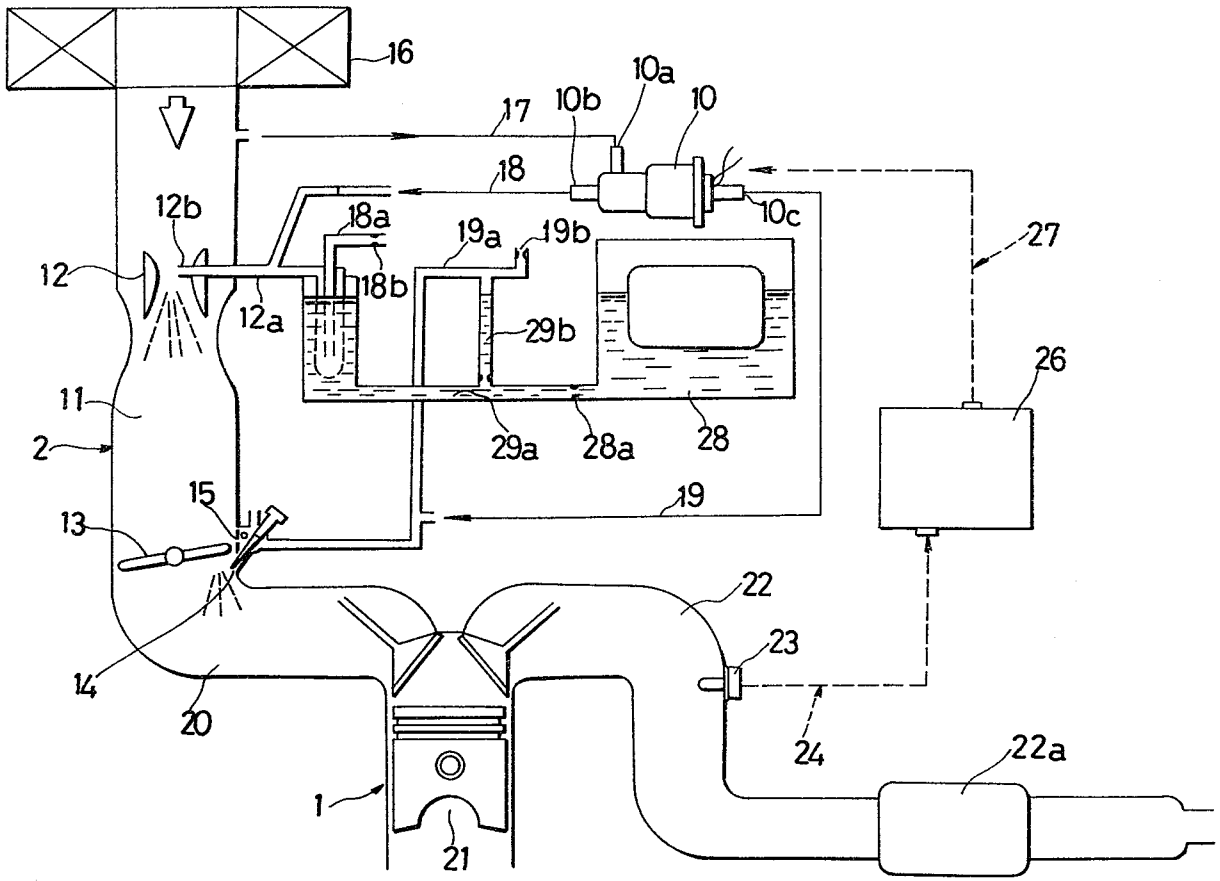
FIG. 1 is a diagrammatic view illustrating the general constitution of an embodiment of the present invention.

Referring to the accompanying drawings and first to FIG. 1, indicated by reference numeral 1 is an internal combustion engine and by reference numeral 2 is a carburetor. The carburetor 2 is mounted on the intake manifold 20 of the combustion engine 1 by means of the air horn tube 11 thereof. A catalytic converter 22*a* having ternary catalytically active substances is attached to the exhaust manifold 22.

The carburetor 2 is provided, within the air horn tube 11, with a venturi tube 12 and a throttle valve 13 and is joined at the downstream end of the air horn tube 11 with the intake manifold 20 of the engine. An air cleaner 16 is attached to the carburetor 2 at the upstream end of the air horn tube 11.

A main nozzle 12*b* formed at one end of a main system fuel tube 12*a* is opened into the venturi tube 12. The main system fuel tube 12*a* is connected to a float chamber 28 through a main system fuel passage 29*a* and a main system adjusting jet 28*a*. An air-bleeding tube 18*a* opening into the atmosphere through a fixed jet 18*b* is arranged within the main system fuel passage 29*a*. The main system fuel tube 12*a* is connected to the first outlet port 10*b* of an electromagnetic control valve 10 through a main system air-bleeding passage 18. A slow system fuel passage 29*b* branches off from the main system fuel passage 29*a*. The slow system fuel passage 29*b* is connected to a slow system fuel supply port including an idling fuel jet 14 and a slow fuel port 15, which open into the air horn tube 11 in the vicinity of the throttle valve 13, through a slow system fuel tube 19*a*. The slow system fuel passage 29*b* further is opened into the atmosphere through a fixed jet 19*b* and is connected to the second outlet port 10*c* of the electromagnetic control valve 10 through a slow system air-bleeding passage 19. The air inlet port 10*a* of the electromagnetic control valve 10 is connected to the air horn tube 11 near the air cleaner 16 through a by-pass passage 17. An oxygen sensor 23 is attached to the exhaust manifold 22 of the internal combustion engine 1. The output signal 24 of the oxygen sensor 23 is applied to an electronic control unit 26. The electromagnetic control valve 10 is controlled by the output signal 27 of the electronic control unit 26.

Figure 2:
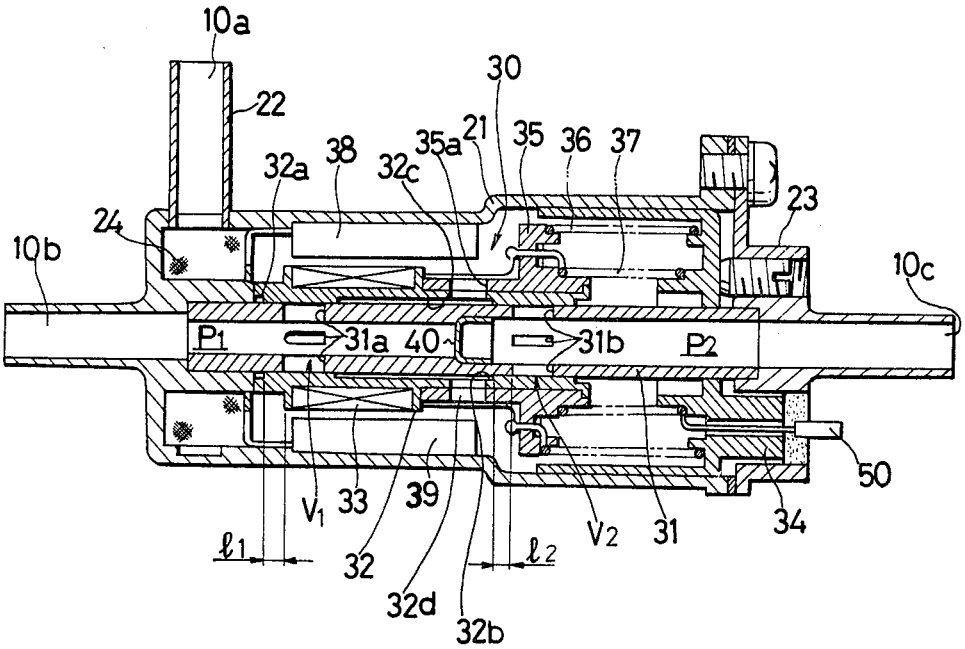
FIG. 2 is sectional view of an electromagnetic control valve shown in FIG. 1.

Referring now to FIG. 2, the electromagnetic control valve 10 has a tubular casing 21 made of a magnetic material and integrally having a first outlet port 10*b* communicating with the main system air-bleeding passage 18 and integrally having a tube 22 provided with the air inlet port 10*a* communicating with the by-pass passage 17. A magnetic cover 23 having the second outlet port 10*c* which is communicated with the slow system air-bleeding passage 19 is hermetically fixed to the casing 21 to form a box-shaped housing. An air filter 24 and a moving-coil type linear motor 30 are enclosed within the box-shaped housing consisting of the casing 21 and the cover 23.

The moving-coil type linear motor 30 comprises a hollow iron core 31 hermetically held between the casing 21 and the cover 23 and is provided with a first passage $P_1$ communicating with the first outlet port 10*b* at the left end thereof and a second passage $P_2$ communicating with the second outlet port 10*c* at the right end thereof, which are separated by a separator 40, a bobbin 32 axially slidably fitted on the hollow iron core 31 in the left portion of the hollow iron core 31, a solenoid 33 wound on the bobbin 32, a spring holder 34 fitted on the hollow iron core 31 in the right portion thereof so as to be adjustable in its position, a pair of conductive compression coil springs 36 and 37 which are interposed between the spring holder 34 and a nonconductive spring holder 35 fitted on the bobbin 32 on the right extension thereof, and a pair of permanent magnets 38 and 39 fixed to the casing 21 with the magnetic flux thereof passing substantially perpendicularly with respect to the winding of the solenoid 33. The terminals of the winding of the solenoid 33 are connected to the respective left ends of the compression coil springs 36 and 37, while lead wires 50 are connected to the respective right ends of the compression coil springs 36 and 37. The compression coil springs 36 and 37 are electrically isolated from the spring holder 34. When an electric current is supplied to the linear motor 30, the electric current flows through one of the lead wires 50, the compression coil spring 36, the solenoid 33, the compression coil spring 37 and the other lead wire 50, so that the bobbin 32 and the solenoid 33 are caused to move axially for a distance proportional to the electric current supplied to the solenoid 33. The separator 40 is hermetically fitted in the hollow iron core 31 to partition the interior of the hollow iron core 31 into a first passage $P_1$ communicating with the first outlet port 10*b* and a second passage $P_2$ communicating with the second outlet port 10*c*.

A plurality of first valve openings 31*a* each of which are the shape of an oblong circle extending axially of the hollow iron core 31 are formed at equal intervals along the circumferential direction in the left portion of the hollow iron core 31. The inner circumference of the left end of the bobbin 32 is cut in a step to form a first valve element 32*a*. A first control valve $V_1$ including the first valve openings 31*a* and the first valve element 32*a* is formed between the hollow iron core 31 and the bobbin 32. While no electric current is supplied to the solenoid 33, the resilient forces of the compression coil springs 36 and 37 cause the first control valve $V_1$ to close the first valve openings 31*a* and the first valve element 32*a* is positioned at an extreme position lying to the left of the first valve openings 31*a* by a distance l1 from the left ends of the first valve openings 31*a*. When the bobbin 32 is caused to move rightward by supplying an electric current to the solenoid 33 of the linear motor 30, the first valve element 32*a* starts opening the first valve openings 31*a* after the bobbin 32 has been moved by a distance l1 (the distance l1 will be designated as "idle stroke l1" hereinafter). Thus the first control valve $V_1$ keeps the first valve openings 31*a* closed while no electric current is supplied to the solenoid 33, whereas control valves $V_1$ causes the bobbin 32 to move rightward for a distance proportional to the intensity of the electric current when an electric current is supplied to the solenoid 33 and causes the first valve openings 31*a* to start opening when the bobbin 32 is moved rightward by an idle stroke l1 from the extreme position where the left end of the bobbin 32 is caused to be in abutment with the housing 21 by the resilient forces of the compression coil springs 36 and 37. After the first valve openings 31*a* have started opening, air is supplied into the main system air-bleeding passage 18 from the inlet port 10*a* through the filter 24, the first valve openings 31*a*, the first passage $P_1$ and the first outlet port 10*b*, in which the quantity of air flow is proportional to the area of the first valve openings 31*a* opened by the first valve element 32*a*.

A plurality of second valve openings 31*b* each of which are the shape of an oblong circle extending axially of the iron core 31 are formed in the right portion of the hollow iron core 31 at equal intervals along the circumferential direction thereof. An annular groove 32*c* is formed in the inner circumference of the right portion of the bobbin 32 so as to communicate with through holes 32*d* formed along the circumference at suitable intervals. The right end of the annular groove 32*c* is stepped to form a second valve element 32*b*. A second control valve $V_2$ including the second valve openings 31*b* and the second valve element 32*b* is formed between the hollow iron core 31 and the bobbin 32. While no electric current is supplied to the solenoid 33 and the bobbin 32 is urged to the extreme position, the second valve openings 31*b* are closed with the bobbin 32 and the second valve element 32*b* is positioned to the left of the second valve openings 31*b* by a distance l2 ($l2<l1$) from the left ends of the second valve openings 31*b*. When an electric current is supplied to the solenoid 33 of the linear motor 30 to cause the bobbin 32 to move rightward, the second valve element 32*b* of the second control valve $V_2$ starts opening the second valve openings 31*b* after the bobbin 32 has moved by a distance l2 (the distance l2 will be designated as "idle stroke l2" hereinafter). Thus the second control valve $V_2$ starts opening the second valve openings 31*b* after the bobbin 32 has moved by the idle stroke l2 from its extreme position, when an electric current is supplied to the solenoid 33. After the second valve openings 31*b* have started opening, air is supplied from the inlet port 10*a* through the filter 24, a through hole 35*a* formed in the spring holder 35, the through hole 32*d* formed in the bobbin 32, the annular groove 32*c*, the second valve openings 31*b*, the second passage $P_2$ and the second outlet port 10*c* into the slow system air-bleeding passage 19, in which the quantity of air flow is proportional to the area of the second valve openings 31*b* opened by the second valve element 32*b*.

Figure 3:
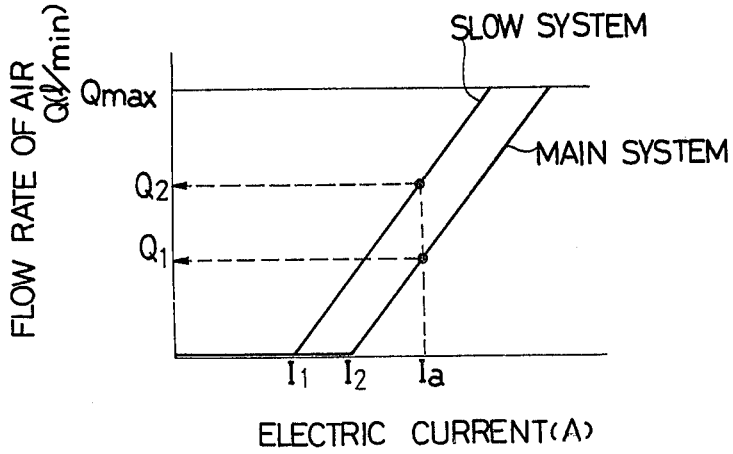
FIG. 3 is a diagram showing the relationship between the electric current and the flow rate of air.

Since the idle stroke l1 is greater than the idle stroke l2, the second control valve $V_2$ starts opening the second valve openings 31*b* earlier than the first control valve $V_1$ starts opening the first valve openings 31*a* by a time corresponding to the difference between the idle strokes l1 and l2 when an electric current is supplied to the solenoid 33 of the linear motor 30 as shown in FIG. 3.

The oxygen sensor, as generally known, is sensitive to the oxygen partial pressure in the exhaust gas. Such an oxygen sensor having a solid electrolyte, preferably made of zirconium oxide, has previously been proposed. It is known that the output of an oxygen sensor of this type changes suddenly in a very short response time when the air-fuel ratio of the air-fuel mixture supplied to an internal combustion engine is equivalent to a fixed value around the stoichiometric air-fuel ratio. Generally, the oxygen sensor does not provide any output signal while the air-fuel ratio of the air-fuel mixture being supplied to the engine is smaller than the fixed value (lean air mixture), whereas the oxygen sensor provides an output signal when the air-fuel ratio exceeds the fixed value. The electronic control unit 26 shown in FIG. 1 is adapted to increase the electric current of the output signal 27 gradually with the lapse of time while the output signal 24 of the oxygen sensor 23 is applied to the electronic control unit 26 and to reduce the electric current of the output signal 27 gradually with the lapse of time while no output signal 24 of the oxygen sensor 23 is applied to the electronic control unit 26. Accordingly, when the output signal 24 of the oxygen sensor 23 is applied to the electronic control unit 26, the electronic control unit 26 supplies an analog electric signal 27, which increases with the lapse of time, to the solenoid 33 to cause the bobbin 32 to move for a distance proportional to the intensity of the analog electric signal 27 so that air is supplied into the main system air-bleeding passage 18 and the slow system air-bleeding passage 19 as described hereinbefore.

The features of the apparatus thus constituted in accordance with the present invention will be described hereinafter with reference to the aforementioned embodiment. The distance of the movement of the bobbin 32 is proportional to the intensity of electric current supplied to the solenoid 33 of the linear motor 30. The idle strokes l1 and l2 of the first control valve $V_1$ and the second control valve $V_2$ of the electromagnetic valve 10, through which the first control valve $V_1$ and the second control valve $V_2$, respectively, are changed from the closed state to the open state are different from each other, namely the idle stroke l1 is greater than the idle stroke l2. Therefore, the second control valve $V_2$ starts opening after the intensity of the electric current has increased up to I1 and then the quantity of air flow increases proportionally to the electric current with the increase of the electric current as illustrated in FIG. 3. The first control valve $V_1$ starts opening after the intensity of the electric current has increased further up to I2 which is greater than the electric current I1 and the quantity of air flow also increases proportionally to the electric current with the increase of the electric current. Since the shape of the valve openings is identical for both control valves $V_1$ and $V_2$, the same maximum quantity of air flow $Q_{max}$ is attained by the first and the second control valves $V_1$ and $V_2$ when they are fully opened. When an electric current $I_a$, which is included within a range in which the flow rates of air change in proportion to the intensity of the electric current, is supplied to the linear motor 30, the flow rate $Q_2$ through the second control valve $V_2$ is greater than the flow rate $Q_1$ through the first control valve $V_1$ due to the difference in opening degree between the first control valve $V_1$ and the second control valve $V_2$.

When the respective sensitivities of the main system and the slow system of a carburetor to air-bleeding rate are changed, the air-bleeding rates for the main system air-bleeding passage 18 and for the slow system air-bleeding passage 19 are to be changed corresponding to the change of the sensitivities, which can easily be attained through changing the idle strokes of the first and the second control valves $V_1$ and $V_2$.

It will be well understood from what has been described hereinbefore that the apparatus for controlling the proportion of air and fuel in the air-fuel mixture of the internal combustion engine in accordance with the present invention is constituted so as to differentiate the opening area between the first control valve for controlling the opening of the main system air-bleeding passage and the opening of the slow system air-bleeding passage in order to attain appropriate air-bleeding for the main and the slow systems. Therefore, smooth acceleration of the internal combustion engine is made possible even if the throttle valve is opened suddenly and thus the object of the present invention is attained.

Furthermore, according to the constitution of the present invention, the first and the second control valves are included integrally in the apparatus. Therefore, the air-bleeding rate can be controlled in various types of carburetors without altering the logic of the electronic control unit for producing the control signals by appropriately designing the respective positions of those valve openings of the control valves to provide appropriate idle strokes l1 and l2. Still further, the respective ratios of the change of flow rate to the electric current of the first control valve and the second control valve within a proportional flow rate control range may be made different from each other by designing the shape of the respective valve openings of the first and the second control valves in different shapes with each other.

Furthermore, the apparatus for controlling the proportion of air and fuel in the air-fuel mixture in accordance with the present invention is provided with an electromagnetic control valve integrally including a first control valve and a second control valve wherein a bobbin having a first valve element and a second valve element for opening and closing first valve openings and second valve openings, respectively, is disposed for sliding movement on an iron core having the first and the second valve openings. Accordingly, the relative characteristics between the control valves will not be affected by the change of the characteristic of the air flow rate to the electric current, even if the sliding resistance between the bobbin and the hollow iron core may change. Such being only the mode of change of the characteristics, the electromagnetic control valve is subject to feedback control employing the output signal of an oxygen sensor. Therefore, the advantage that the air-fuel mixture will not become excessively lean even if the throttle valve is opened suddenly, remains unchanged.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An apparatus for controlling the proportion of air and fuel in the air-fuel mixture of an internal combustion engine having an intake manifold, a main system fuel passage and a slow system fuel tube, comprising:

a carburetor including an air horn tube having a venturi tube with a main nozzle and a throttle valve connected to the intake manifold of an internal combustion engine, said venturi tube having a main system fuel tube opening into said main nozzle at a first end thereof and communicating with a main system fuel passage through a second end thereof, said slow system fuel tube opening into a slow system fuel supply port formed near said throttle valve of the air horn tube at a first end thereof and communicating with said slow system fuel passage through a second end thereof, a main system air-bleeding passage connected to said main system fuel tube for supplying air thereto, and a slow system air-bleeding passage connected to said slow system fuel tube for supplying air thereto;

an electromagnetic control valve including a box-shaped housing formed with a magnetic material and provided with an air-inlet port, a first outlet port connected to said main system air-bleeding passage and an air-bleeding passage, a tubular iron core supported on said housing at opposite ends thereof, having a first passage and a second passage communicating with said first outlet port and with said second outlet port, respectively, and being formed separately with each other and internally of the iron core, at least one first valve opening formed in a part of the iron core provided with said first passage so as to allow communication between said first outlet port and said air-inlet port, and at least one second valve opening formed in a part of the core provided with said second passage so as to allow communication between said second outlet port and said air inlet port, a bobbin having a solenoid wound partially along the longitudinal length thereof and having a first valve element and a second valve element which are formed so as to open and close the at least one first valve opening and the at least one second valve opening, respectively, formed in said iron core, spring means urging said bobbin in a longitudinal direction of said iron core, and at least one pair of permanent magnets fixed to said housing at a position corresponding to said solenoid formed on said bobbin and so disposed that the direction of the magnetic flux is perpendicular to said solenoid; and control means for applying analog electric signals to said solenoid, wherein the first valve element and the second valve element are in a positional relationship such that said first valve element starts opening said at least one first valve opening a predetermined time after said second valve element has started opening said at least one second valve opening when the bobbin is caused to slide on said iron core against the resilient force of said spring means due to application of said analog electric signals to said solenoid.

2. An apparatus according to claim 1, wherein said first valve element is formed at one longitudinal end of said bobbin, said bobbin is urged by said spring means in a direction so as to be in abutment with said housing, and wherein a distance between the first valve element and an end edge of the at least one first valve opening is greater than a distance between the second valve element and an end edge of the at least one second valve opening by a predetermined length when the end of said bobbin having said first valve element is in abutment with said housing.

3. An apparatus according to claim 1, wherein said solenoid includes a winding having terminals and said spring means further comprises a first and second separate conductive coil spring and wherein a first end of said first coil spring is connected to one of the terminals of said winding of said solenoid while a first end of said second coil spring is connected to another one of the terminals of the winding of said solenoid, and the control means which applies analog electric signals to said solenoid further comprises a plurality of lead wires connected to respective second ends of said first and second conductive coil springs opposite said first ends.

4. An apparatus according to claim 1, wherein said means for applying analog electric signals to said solenoid further comprises an oxygen sensor attached to the exhaust passage of said internal combustion engine and an electronic control unit for generating analog electric signals corresponding to the output signals of said oxygen sensor and for applying the analog electric signals to said solenoid.

* * * * *